United States Patent [19]

Schilling

[11] 4,133,263

[45] Jan. 9, 1979

[54] SHEET-TURNING DRUM FOR PRINTING MACHINES CONVERTIBLE FROM PRINTING ON ONE SIDE OF A SHEET TO PRINTING ON BOTH SIDES OF A SHEET AND VICE VERSA

[75] Inventor: Paul Schilling, Neckargemund, Germany

[73] Assignee: Heidelberger Druckmaschinen AG, Heidelberg, Germany

[21] Appl. No.: 734,674

[22] Filed: Oct. 21, 1976

[30] Foreign Application Priority Data

Oct. 22, 1975 [DE] Fed. Rep. of Germany ..... 2547251

[51] Int. Cl.[2] ..... B41F 21/04

[52] U.S. Cl. ..... 101/409; 101/232; 271/277

[58] Field of Search ..... 271/277, 82; 101/408–411, 415.1, 230–232

[56] References Cited

U.S. PATENT DOCUMENTS

| | | | |
|---|---|---|---|
| 2,619,903 | 12/1952 | Albrecht | 101/409 |
| 3,362,327 | 1/1968 | Luehrs | 101/415.1 |
| 3,385,597 | 5/1968 | Guzik | 101/411 |
| 3,899,970 | 8/1975 | Jurny et al. | 101/230 |
| 3,929,069 | 12/1975 | Jahn | 271/277 |
| 4,026,209 | 5/1977 | Wirz et al. | 101/232 |

*Primary Examiner*—William Pieprz
*Attorney, Agent, or Firm*—Herbert L. Lerner

[57] ABSTRACT

A sheet-turning drum assembly for printing machines convertible from printing on one side of a sheet to printing on both sides of a sheet and from printing on both sides of a sheet to printing on one side of a sheet includes a drum and tongs-type grippers pivotally mounted on the drum and including a pair of tongs-type gripper halves. Separate drive members are operatively connected to the respective tongs-type gripper halves for controllably pivoting each of the tongs-type gripper halves, and a torsion bar spring is disposed between the separate drive members for mutually bracing the latter resiliently against one another.

2 Claims, 4 Drawing Figures

SHEET-TURNING DRUM FOR PRINTING MACHINES CONVERTIBLE FROM PRINTING ON ONE SIDE OF A SHEET TO PRINTING ON BOTH SIDES OF A SHEET AND VICE VERSA

The invention relates to a sheet-turning or turn-over drum assembly for printing machines convertible from printing on one side of a sheet of printing on both sides of a sheet and vice versa, such machines being also often referred to as convertible perfecting machines. More particularly, the invention relates to such a sheet-turning drum assembly that is provided with tongs-type grippers that are pivotable about a pivot and that include a pair of tongs-type gripper halves controllable by separate drive members.

In a heretofore known turning drum of this general type (German Published Non-Prosecuted Application DT-OS No. 24 14 998), the halves of the tongs-type grippers are separately controlled from respective sides of the drum. In this known device, one tongs-type gripper half is fastened onto a shaft and the other onto a tube coaxially surrounding the shaft. The shaft and the tube are controllable by gears disposed on respectively opposite sides of the drum. Toothed drive members mesh with the gears, the drive members being pivotable about pivot pins.

In the foregoing heretofore known device, each drive member is provided with a follower roller which selectively cooperates with two control cams. The rollers are disposed on the two drive members to the right-hand side of the pivot pin of the one drive member and to the left-hand side of the pivot pin of the other drive member, as viewed in peripheral direction. By means of compression springs disposed between the drum body and the drive members, the rollers are pressed on both sides thereof against the control cams with great spring force.

The drive members of the aforementioned previously known sheet-turning drum exert control over the tongs-type grippers through the control cams so that, when opening and closing the same, both tongs-type gripper halves are simultaneously moved, and also, when pivoting the tongs-type grippers when printing on both sides of a sheet (perfector printing), both tongs-type gripper halves execute a parallel pivoting movement.

In particular, the pivoting movement of the tongs-type grippers for printing on both sides of a sheet, which amounts to a traversal through an angle of about 180°, requires maximal pivoting of the drive members by the control cams. The compression springs for applying pressure to the follower rollers are thereby stressed over a relatively large spring deflection so that the spring force is varied accordingly.

The fluctuations or deviations of the spring forces in the heretofore known device entails the disadvantage that they may act as additional driving or retarding forces upon the drive of the drum and can have an effect upon the uniform rotation thereof. In addition, the torque deviations resulting therefrom can also result in mackling during printing. Furthermore, additional vibration pulses are produced in the printing machine and may result in increased wear thereof.

It is accordingly an object of the invention to provide a sheet-turning drum assembly for printing machines convertible from printing on one side of a sheet to printing on both sides of a sheet and vice versa which avoids the foregoing shortcomings of heretofore known sheet-turning drums of this general type and applied the necessary forces without any significant torque deviations or vibrations in the turning drum and thereby increases the useful power of the machine.

With the foregoing and other objects in view, there is provided, in accordance with the invention, a sheet-turning drum assembly for printing machines convertible from printing on one side of a sheet to printing on both sides of a sheet and vice versa comprising a drum tongs-type grippers pivotally mounted on the drum and including a pair of tongs-type gripper halves, separate drive members operatively connected to the respective tongs-type gripper halves for controllably pivoting each of the tongs-type gripper halves, the separate drive members being resiliently braced against one another.

By resiliently bracing the drive members against one another, assurance is afforded that the bearing forces of the follower rollers on the control cams will not vary when both tongs-type gripper halves are pivoted for printing on both sides of a sheet. In this phase, both tongs-like gripper halves move parallel to one another. Only for the purpose of opening and closing the tongs-like grippers does a slight change in the bearing forces occur, but it cannot have any negative effect, however, upon the rotary motion of the sheet-turning drum. Also, due to the constant bearing force of the follower rollers virtually no torque deviations occurs at the drive of the sheet-turning drum, so that vibriations can be avoided and the driving force diminished, which results in smooth running and increased outputs of the machine.

In accordance with another feature of the invention, a prestressed torsion bar spring is disposed between the drive members of the respective tongs-type gripper halves. Consequently, only relatively little space is required for this structural feature inside the body of the sheet-turning drum.

In accordance with a further feature of the invention, the sheet-turning drum assembly includes pivot pin means disposed on the drum for pivotally carrying the separate drive members, spring bearings mounted on the pivot pin means, the torsion bar spring being held in the spring bearings and being received in a cavity formed in the drum.

In accordance with an added feature of the invention, the spring bearings are formed with a slot and are fastened to the pivot pin means.

In order to avoid soiling of the torsion bar spring and the bearings therefore in the drum and in accordance with a concomitant feature of the invention, both the torsion bar spring and the spring bearings are received in the cavity formed in the drum, and a filling member is provided covering the torsion bar spring and the spring bearings and closing the cavity.

Other features which are considered as characteristic for the invention are set forth in the appended claims.

Although the invention is illustrated and described herein as embodied in sheet-turning drum for printing machines convertible from printing on one side of a sheet to printing on both sides of a sheet and vice versa, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
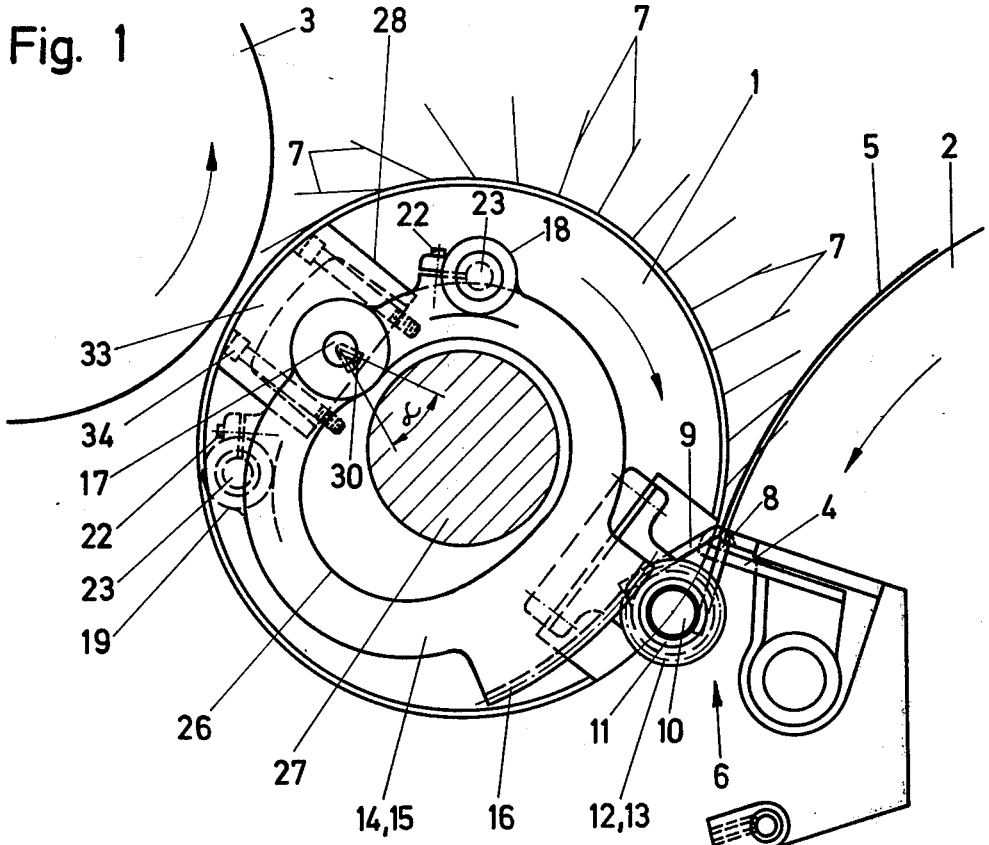
FIG. 1 is a diagrammatic side elevational view of a sheet-turning drum with tongs-type grippers set for transfering a sheet for single-side or recto-printing.

Referring now to the figures of the drawing, there is shown therein an embodiment of the sheet-turning drum 1 according to the invention which is disposed between a transfer drum 2 and an impression cylinder 3 of a printing machine. The transfer drum 2 has two mutually diametrically opposed gripper systems 4 at the periphery thereof, by means of which sheets 5 are taken over from a first printing unit of the printing machine. In the interest of clarity, the first and the succeeding printing units are not shown in the drawing.

Figure 2:
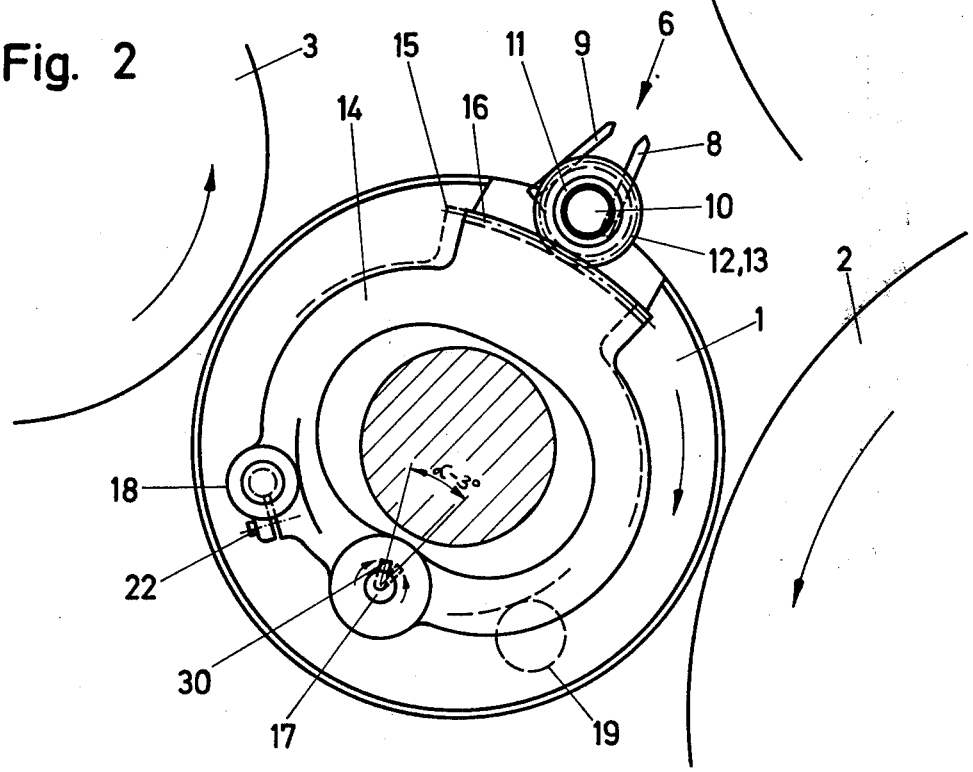
FIG. 2 is a view similar to that of FIG. 1 showing the sheet-turning drum with the tongs-type grippers thereof being pivoted.

In FIG. 1, the sheet 5 is shown being gripped at the leading edge thereof by tongs-type grippers 6 and guided around the sheet-turning drum 1. After about half a revolution of the turning drum 1, the sheet 5 is transfered in a similar manner to non-illustrated grippers of the impression cylinder 3. On the latter, the sheet 5 is then given a second imprinting on the same side thereof when the machine is set to perform single-side or recto-printing. To transfer the sheet 5, the tongs-type grippers are pivoted substantially radially out of the periphery of the sheet-turning drum 1, and pivoted back again to receive the next following sheet 5. The maximal pivot movement is shown in FIG. 2. The pivoting of the tongs-type grippers 6 occurs in the open i.e. non-clamping, position thereof as shown diagrammatically by the pairs of lines 7 representing the successive positions of the pair of pivoting jaws 8 and 9 of the grippers 6.

The gripper jaw or gripper half 8 is secured to a shaft 10 and the gripper jaw 9 to a tube 11 coaxially surrounding the shaft 10.

Figure 4:
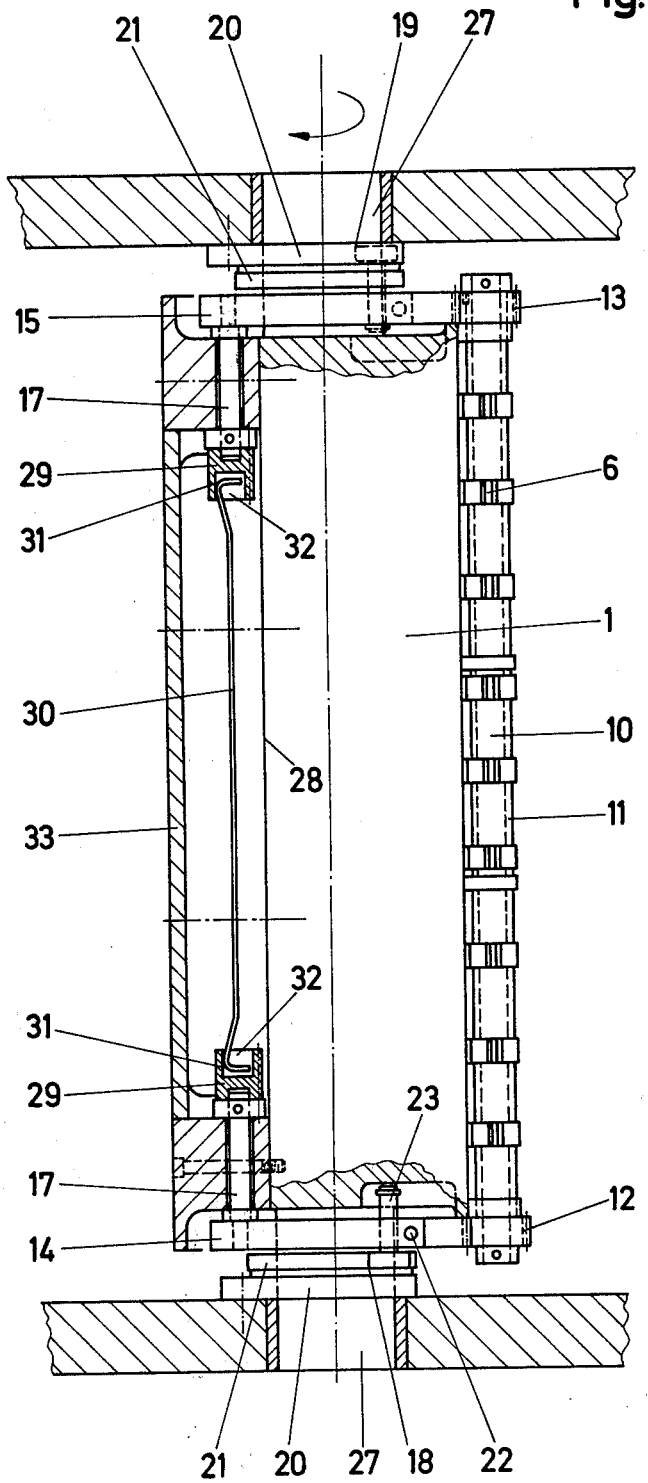
FIG. 4 is a longitudinal view partly in section of the sheet-turning drum.

A gear 12 for controlling the gripper half 8 is secured to the shaft 10 on one side of the drum 1, and a gear 13 for controlling the gripper half 9 is secured to the tube 11 on the other side of the drum 1 (FIG. 4). Both gears 12 and 13 are separately controlled, each from a respective side of the drum 1, by drive members 14 and 15 having toothing 16 that meshes with the gears 12 and 13. The drive members 14 and 15 are mounted on the turning drum 1 for pivoting about coaxially extending pivot pins 17 at the center of the toothing 16.

Each drive member 14, 15 is provided with a respective follower roller 18, 19, the roller 18 being mounted on the front side of the drum 1 (FIG. 1) to the right-hand side of the pivot pin 17, and the roller 19 on the rear side of the drum 1 and to the left-hand side of the pivot pin 17. The two follower rollers 18 and 19 are axially shiftable and are selectively cooperable with two control cams 20 and 21. In order to shift the follower rollers 18 and 19, clamping screws 22 are loosened so that the roller pins 23 together with the respective rollers 18 and 19 can be shifted from one control cam to the other.

Figure 3:
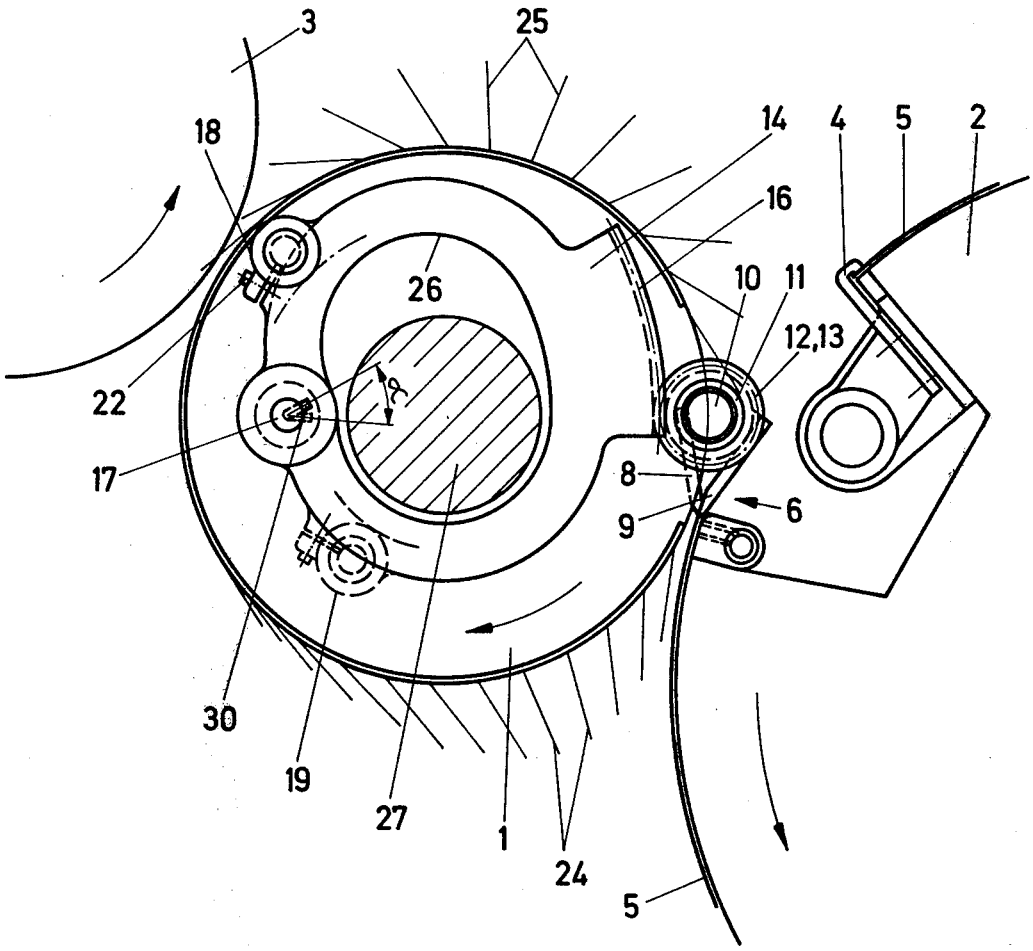
FIG. 3 is another view similar to those of FIGS. 1 and 2 showing the sheet-turning drum with the tongs-type grippers set for transfering a sheet for double-side or perfector printing.

After adjusting the follower rollers 18 and 19 so that the machine is set for perfector printing i.e. printing on both sides of the sheet, the tongs-type grippers 6 grip the end of the sheet 5 and convey it as represented by the lines 24 (FIG. 3) around the sheet-turning drum 1, and surrender the thus-gripped end of the sheet 5 with maintained registry to the grippers of the impression cylinder 3. The sheet 5 is thereby turned over so that both sides thereof can be printed on i.e. one side thereof can be printed on in the first printing unit (recto-printing) and the other side thereof can be printed on in the next following printing unit (perfector printing). After the surrender or transfer of the sheet to the grippers of the impression cylinder 3, the tongs-type grippers 6 return to the starting position thereof in accordance with the representation by the lines 25 of the successive positions of the gripper jaws 8 and 9 thereof. In the course thereof, the grippers 6 travel back through an angle of substantially 180°. In order to permit free movement of the drive members 14 and 15, they are formed with recesses or cutouts 26 for the journals 27 of the drum 1.

The ends of the pivot pins 17 located opposite to the ends thereof adjacent the drive members 14 and 15 extend into a cavity or depression 28 formed in the sheet-turning drum 1 and are provided therein with spring bearings 29 for receiving or taking up a torsion bar spring 30. The latter is provided with bent-over ends 31 with which it is held in slots 32 formed in the spring bearings 29.

The cavity 28, with the torsion bar spring 30 and the spring bearings 29 disposed therein, is covered by a filling member 33 which is fastened by screws 34 to the sheet turn-over drum 1.

The torsion bar spring 30 is prestressed about an angle $\alpha$ and consequently produces the bearing force of both follower rollers 18 and 19 through the mutual bracing of both drive members 14 and 15. A prerequisite thereof is that both follower rollers 18 and 19 should be disposed on opposite sides with respect to the pivot pins 17. The angle $\alpha$ varies by only 3° for the purpose of opening and closing both halves 8 and 9 of the tongs-type grippers 6. This is attained due to the high transmission ratio between the toothing 16 and the gears 12 and 13.

For the pivoting movement of the tongs-type grippers 6 (especially for perfector printing) which extends over an angle of about 180°, no additional angular movement at the torsion bar spring 30 is necessary, because the two halves 8 and 9 of the tongs grippers 6 always move in parallel with one another. Thus, in the lower region of the sheet turning drum 1, the parallel pivoting movement of the tongs-type grippers 6 in closed condition is necessary to hold the sheet 5. In the upper region of the sheet-turning drum 1, the sheet 5 has already been surrendered to the impression cylinder 3, and the jaws or halves 8 and 9 of the tongs-type grippers 6 are opened (FIG. 2). Here again, the pivoting movement of the gripper halves 8 and 9 is in parallel i.e. the opening width of both halves 8 and 9 of the tongs-type grippers 6 is unchanged. Consequently, only a common pivoting of both drive members 14 and 15 occurs, this pivoting being followed by the torsion rod spring 30 without any variation in the prestressing thereof. The pivoting is attained by suitable construction or conformation of both control cams 20 and 21.

The pivoting movement of the halves 8 and 9 of the tongs-type grippers 6 during single-side or recto-printing in accordance with the lines 7 in FIG. 1 takes place in a similar manner i.e. the tongs-type grippers 6 remain open in the upper region of the sheet-turning drum 1 until the next following sheet 5 is received or taken up. Also, in this case, the angle $\alpha$ varies only by about 3° during opening and closing of both halves 8 and 9 of the tongs-type grippers 6.

There are claimed:

1. Sheet-turning drum assembly for printing machines convertible from printing on one side of a sheet to printing on both sides of a sheet and from printing on both sides of a sheet to printing on one side of a sheet, comprising a drum, a shaft rotatably mounted on said drum, a tube surrounding said shaft and rotatable relative thereto, tongs-type grippers including a pair of tongs-type gripper halves each respectively mounted on said shaft and said tube for pivotal movement relative to one another, respective gears mounted on said shaft and said tube at opposite ends of said drum, separate toothed drive members respectively meshing with said gears for controllably pivoting each of said tongs-type gripper halves separately and independently of one another, pivot pin means disposed on said opposite ends of said drum for pivotally carrying said separate drive members, spring bearings mounted on said pivot pin means, means for mutually bracing said separate drive members resiliently against one another, said mutual bracing means comprising a prestressed torsion bar spring disposed between the drive members of the respective tongs-type gripper halves and having respective ends thereof secured in said spring bearings at said opposite ends of said drum, respective control cams mounted on said opposite ends of said drum, and respective follower rollers secured to said separate drive members and being in rolling engagement with the respective control cams under spring-loading by said prestressed torsion bar spring.

2. Sheet-turning drum assembly according to claim 1, said torsion bar spring and said spring bearings being received in a cavity formed in said drum.

* * * * *